US009748084B2

(12) United States Patent
St. Cyr et al.

(10) Patent No.: US 9,748,084 B2
(45) **Date of Patent: *Aug. 29, 2017**

(54) DIRECT SAMPLE ANALYSIS DEVICE ADAPTERS AND METHODS OF USING THEM

(71) Applicant: PerkinElmer Health Sciences, Inc., Waltham, MA (US)

(72) Inventors: Paul L. St. Cyr, Shelton, CT (US); Michael L. DelVecchio, Stratford, CT (US); Craig M. Whitehouse, Branford, CT (US)

(73) Assignee: PerkinElmer Health Sciences, inc., Waltham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/810,320

(22) Filed: Jul. 27, 2015

(65) Prior Publication Data

US 2016/0071712 A1 Mar. 10, 2016

Related U.S. Application Data

(63) Continuation of application No. 13/662,745, filed on Oct. 29, 2012, now Pat. No. 9,117,641.

(51) Int. Cl.
*H01J 49/00* (2006.01)
*H01J 49/04* (2006.01)

(52) U.S. Cl.
CPC ..... *H01J 49/0404* (2013.01)

(58) Field of Classification Search
CPC ..... H01J 49/0404
USPC ..... 250/281, 282, 283, 288, 289
See application file for complete search history.

(56) References Cited

U.S. PATENT DOCUMENTS

| | | | | |
|---|---|---|---|---|
| 5,157,260 | A | 10/1992 | Mylchreest | |
| 5,571,410 | A | 11/1996 | Swedberg | |
| 5,965,883 | A | 10/1999 | Lee | |
| 6,361,745 | B1 | 3/2002 | Regan | |
| 6,395,554 | B1 | 5/2002 | Regan | |
| 6,485,918 | B1 | 11/2002 | Schermer | |
| 7,361,208 | B2 | 4/2008 | Botelho | |
| 7,671,345 | B2 | 3/2010 | Blackmore | |
| 9,117,641 | B2 * | 8/2015 | St. Cyr | H01J 49/0404 |
| 2003/0044837 | A1 | 3/2003 | Schermer | |
| 2003/0070913 | A1 | 4/2003 | Miller | |
| 2004/0056192 | A1 | 3/2004 | Truche | |
| 2004/0110275 | A1 | 6/2004 | Sandell | |

(Continued)

FOREIGN PATENT DOCUMENTS

WO 2010114859 12/2010

OTHER PUBLICATIONS

ISR/WO for PCT/US2013/066993.

(Continued)

*Primary Examiner* — Wyatt Stoffa
*Assistant Examiner* — Hanway Chang
(74) *Attorney, Agent, or Firm* — Rhodes IP PLC; Christopher R Rhodes

(57) ABSTRACT

Certain embodiments described herein are directed to adapters for use in coupling a direct sample analysis device to an analytical instrument such as, for example, a mass spectrometer. In some examples, the adapter can include an internal coupler separated from an external coupler through an insulator.

15 Claims, 12 Drawing Sheets

(56) References Cited

U.S. PATENT DOCUMENTS

| | | | | |
|---|---|---|---|---|
| 2005/0116163 | A1* | 6/2005 | Park | H01J 49/0404 250/288 |
| 2005/0133714 | A1 | 6/2005 | Vestal | |
| 2005/0247701 | A1 | 11/2005 | Deka | |
| 2005/0258088 | A1 | 11/2005 | Botelho | |
| 2006/0054805 | A1 | 3/2006 | Flanagan | |
| 2006/0207115 | A1 | 9/2006 | Truche | |
| 2008/0047323 | A1 | 2/2008 | Botelho | |
| 2008/0067367 | A1 | 3/2008 | Park | |
| 2008/0105033 | A1 | 5/2008 | Tipler | |
| 2009/0014640 | A1 | 1/2009 | Schaumloffel | |
| 2009/0032695 | A1 | 2/2009 | Kaye | |
| 2010/0059674 | A1 | 3/2010 | Chen | |
| 2010/0136699 | A1 | 6/2010 | Drese | |
| 2011/0032611 | A1 | 2/2011 | Mick | |
| 2011/0122396 | A1 | 5/2011 | Ivaldi | |
| 2012/0145890 | A1 | 6/2012 | Goodlett | |
| 2012/0285325 | A1 | 11/2012 | Tipler | |
| 2012/0312980 | A1 | 12/2012 | Whitehouse | |

OTHER PUBLICATIONS

ISR/WO for PCT/US2013/066994.
ISR/WO for PCT/US2013/066995.
AxION Direct Sample analysis System. https://www.youtube.com/watch?v=ZTxr9gCU_Qw.

* cited by examiner

DIRECT SAMPLE ANALYSIS DEVICE ADAPTERS AND METHODS OF USING THEM

TECHNOLOGICAL FIELD

Certain features, aspects and embodiments are directed to an adapter configured to permit coupling of a direct sample analysis device to an analytical instrument. In some embodiments, the adapter is configured to couple the direct sample analysis device to a mass spectrometer.

BACKGROUND

Direct sample analysis permits analysis of a sample by directly introducing the sample into an instrument. If desired, front-end chromatography separation can be omitted prior to analysis of the sample.

SUMMARY

Certain features, aspects and embodiments described herein are directed to adapters and/or components thereof that can couple a direct sample analysis device to an analytical instrument such as, for example, a mass spectrometer. The exact configuration of the adapter an vary and in some instances, the adapter may comprise a single integral component or one or more separate components which together can function to permit coupling of the direct sample analysis device to the analytical instrument.

In one aspect, an adapter for installing a direct sample analysis device on a mass spectrometer is provided. In certain examples, the adapter comprises a capillary sleeve configured to couple to a capillary inlet of the mass spectrometer, and an end cap extension configured to couple to the capillary sleeve, in which the capillary sleeve and end cap extension are configured to provide fluidic coupling between a sample holder and the mass spectrometer through the capillary inlet.

In certain embodiments, the end cap extension is configured to couple to a lens assembly. In other embodiments, the lens assembly is configured to slidingly engage to the end cap extension. In further embodiments, the end cap extension is configured to slidingly engage to the capillary sleeve. In some examples, the capillary sleeve couples to the capillary inlet through a friction fit. In additional examples, the end cap extension couples to the capillary sleeve through a friction fit. In some embodiments, the capillary sleeve comprises an insulator configured to electrically decouple the capillary sleeve from the end cap extension. In other embodiments, the capillary sleeve is further configured to center the capillary inlet. In certain examples, the end cap extension comprises an insulator configured to electrically decouple the capillary sleeve from the end cap extension. In some embodiments, the end cap extension is further configured to center the capillary inlet.

In an additional aspect, an adapter for installing a direct sample analysis device on a mass spectrometer, the adapter comprising an internal sleeve configured to couple to a capillary inlet of the mass spectrometer, an external sleeve coupled to the internal capillary sleeve, and an insulator between the internal sleeve and the external sleeve to electrically decouple the internal sleeve from the external sleeve, in which the adapter is configured to provide fluidic coupling between a sample holder and the mass spectrometer through the capillary inlet is disclosed.

In certain embodiments, the external sleeve is configured to couple to a lens assembly. In other embodiments, the lens assembly is configured to slidingly engage to the external sleeve. In further examples, the external sleeve is configured to slidingly engage to the internal sleeve. In some examples, the internal sleeve couples to the capillary inlet through a friction fit. In additional examples, the external sleeve couples to the internal sleeve through a friction fit. In some embodiments, the internal sleeve is sized and arranged to center the capillary inlet in the internal sleeve. In other embodiments, the insulator comprises at least one ceramic material. In certain examples, the adapter is configured to permit coupling of the direct sample analysis device while maintaining a vacuum of the mass spectrometer. In certain examples, the adapter is configured to permit coupling of the direct sample analysis device without removing any lenses of the mass spectrometer.

In another aspect, an adapter for installing a direct sample analysis device on a mass spectrometer, the adapter comprising an internal coupler configured to engage a capillary inlet of the mass spectrometer, an external coupler sized and arranged to engage a direct sample analysis lens assembly, and an insulator between the internal coupler and the external coupler to electrically decouple the internal coupler and the external coupler, in which the adapter is configured to provide fluidic coupling between a sample holder and the mass spectrometer through the capillary inlet is provided.

In some embodiments, the external coupler is configured to engage the lens assembly through a friction fit. In other examples, the internal coupler engages the capillary inlet through a friction fit. In certain examples, the internal coupler is sized and arranged to center the capillary inlet within the internal coupler. In further examples, the insulator comprises at least one ceramic material. In certain examples, the ceramic material is one of alumina, yttria, titania or mixtures thereof. In certain embodiments, each of the external coupler and the internal coupler comprises a substantially inert material. In other embodiments, the substantially inert material is a stainless steel. In some examples, the adapter is configured to permit coupling of the direct sample analysis device while maintaining a vacuum of the mass spectrometer. In certain examples, the adapter is configured to permit coupling of the direct sample analysis device without removing any lenses of the mass spectrometer.

In an additional aspect, an adapter for installing a direct sample analysis device on a mass spectrometer, the adapter comprising a coupler sized and arranged to engage to a capillary inlet of the mass spectrometer, the coupler comprising an internal surface configured to engage to the capillary of the capillary inlet and an external surface electrically isolated from the internal surface through an insulator, in which the adapter is configured to provide fluidic coupling between a sample holder and the mass spectrometer through the capillary inlet is described.

In certain examples, the external surface of the coupler is configured to couple to a lens assembly through a friction fit. In certain embodiments, the internal surface engages the capillary inlet through a friction fit. In certain examples, the internal surface is concentric and is sized and arranged to center the capillary inlet within the internal coupler. In some embodiments, the insulator comprises at least one ceramic material. In certain examples, the ceramic material is one of alumina, yttria, titania or mixtures thereof. In some examples, each of the external surface and the internal surface each comprise a substantially inert material. In some embodiments, the substantially inert material is a stainless steel. In other embodiments, the adapter is configured to permit coupling of the direct sample analysis device while maintaining a vacuum of the mass spectrometer. In further embodiments, the adapter is configured to permit coupling of the direct sample analysis device without removing any lenses of the mass spectrometer.

In another aspect, a system for performing direct sample analysis, the system comprising a direct sample analysis device, and an adapter for installing a direct sample analysis device on a mass spectrometer, the adapter comprising a capillary sleeve configured to couple to a capillary inlet of the mass spectrometer, and an end cap extension configured to couple to the capillary sleeve, in which the capillary sleeve and end cap extension are configured to provide fluidic coupling between a sample holder and the mass spectrometer through the capillary inlet is disclosed.

In certain embodiments, the end cap extension is configured to couple to a lens assembly. In other embodiments, the lens assembly is configured to slidingly engage to the end cap extension. In further embodiments, the end cap extension is configured to slidingly engage to the capillary sleeve. In additional embodiments, the capillary sleeve couples to the capillary inlet through a friction fit. In some examples, the end cap extension couples to the capillary sleeve through a friction fit. In other examples, the capillary sleeve comprises an insulator configured to electrically decouple the capillary sleeve from the end cap extension. In further examples, the capillary sleeve is further configured to center the capillary inlet. In some examples, the end cap extension comprises an insulator configured to electrically decouple the capillary sleeve from the end cap extension. In other embodiments, the end cap extension is further configured to center the capillary inlet.

In another aspect, a system for performing direct sample analysis, the system comprising a direct sample analysis device, and an adapter for installing a direct sample analysis device on a mass spectrometer, the adapter comprising an internal sleeve configured to couple to a capillary inlet of the mass spectrometer, an external sleeve coupled to the internal capillary sleeve, and an insulator between the internal sleeve and the external sleeve to electrically decouple the internal sleeve from the external sleeve, in which the adapter is configured to provide fluidic coupling between a sample holder and the mass spectrometer through the capillary inlet is provided.

In certain examples, the external sleeve is configured to couple to a lens assembly. In some examples, the lens assembly is configured to slidingly engage to the external sleeve. In other examples, the external sleeve is configured to slidingly engage to the internal sleeve. In further examples, the internal sleeve couples to the capillary inlet through a friction fit. In additional examples, the external sleeve couples to the internal sleeve through a friction fit. In some embodiments, the internal sleeve is sized and arranged to center the capillary inlet in the internal sleeve. In additional embodiments, the insulator comprises at least one ceramic material. In other examples, the adapter is configured to permit coupling of the direct sample analysis device while maintaining a vacuum of the mass spectrometer. In further examples, the adapter is configured to permit coupling of the direct sample analysis device without removing any lenses of the mass spectrometer.

In an additional aspect, a system for performing direct sample analysis, the system comprising a direct sample analysis device, and an adapter for installing a direct sample analysis device on a mass spectrometer without breaking the vacuum of the mass spectrometer, the adapter comprising a coupler sized and arranged to engage to a capillary inlet of the mass spectrometer, the coupler comprising an internal surface configured to engage to the capillary of the capillary inlet and an external surface electrically isolated from the internal surface through an insulator, in which the adapter is configured to provide fluidic coupling between a sample holder and the mass spectrometer through the capillary inlet is described.

In certain embodiments, the external surface of the coupler is configured to couple to the lens assembly through a friction fit. In other embodiments, the internal surface engages the capillary inlet through a friction fit. In additional embodiments, the internal surface is concentric and is sized and arranged to center the capillary inlet within the adapter. In further example, insulator comprises at least one ceramic material. In some examples, the ceramic material is one of alumina, yttria, titania or mixtures thereof. In additional examples, each of the external surface and the internal surface comprises a substantially inert material. In some examples, the substantially inert material is a stainless steel. In some embodiments, the adapter is configured to permit coupling of the direct sample analysis device while maintaining a vacuum of the mass spectrometer. In certain examples, the adapter is configured to permit coupling of the direct sample analysis device without removing any lenses of the mass spectrometer.

In another aspect, a method of installing a direct sample analysis device on a mass spectrometer while maintaining a vacuum in the mass spectrometer, the method comprising coupling a capillary extension to the capillary inlet, and coupling an end cap extension to the coupled capillary extension, in which the coupled capillary extension and coupled capillary end cap are configured to provide fluidic coupling between a direct sample analysis sample holder and the mass spectrometer through the capillary inlet is provided.

In certain embodiments, the method comprises removing a capillary nozzle cap prior to coupling the capillary extension to the capillary inlet. In other embodiments, the method comprises coupling a direct sample analysis lens assembly to the coupled end cap extension. In some examples, the end cap extension comprises an insulator configured to electrically isolate the capillary extension from the end cap extension. In other examples, the capillary extension comprises an insulator configured to electrically isolate the capillary extension from the end cap extension.

In an additional aspect, a method of installing a direct sample analysis device on a mass spectrometer while maintaining a vacuum in the mass spectrometer, the method comprising coupling an internal sleeve to a capillary inlet of the mass spectrometer, and coupling an external sleeve to the coupled internal capillary sleeve, the external sleeve comprising an insulator configured to be positioned between the internal capillary sleeve and the external sleeve to electrically isolate the internal sleeve from the external sleeve, in which the coupled internal and external sleeves are configured to provide fluidic coupling between a direct sample analysis sample holder and the mass spectrometer through the capillary inlet is provided.

In certain embodiments, the method comprises removing a capillary nozzle cap prior to coupling the internal sleeve to the capillary inlet. In other embodiments, the method comprises coupling a lens assembly to the coupled external sleeve. In some embodiments, the external sleeve comprises an insulator configured to electrically isolate the internal sleeve from the external sleeve. In other embodiments, the internal sleeve comprises an insulator configured to electrically isolate the internal sleeve from the external sleeve.

In another aspect, a method of installing a direct sample analysis device on a mass spectrometer comprising a capillary inlet while maintaining a vacuum in the mass spectrometer, the method comprising coupling an adapter comprising a coupler sized and arranged to engage to a capillary inlet of the mass spectrometer, the coupler comprising an internal surface configured to engage to the capillary of the capillary inlet and an external surface electrically isolated from the internal surface through an insulator, in which the adapter is configured to provide fluidic coupling between a sample holder and the mass spectrometer through the capillary inlet is described.

In certain examples, the method comprises removing a capillary nozzle cap prior to coupling the internal surface to the capillary inlet. In other examples, the method comprises coupling a lens assembly to the coupled external surface. In certain embodiments, the method comprises initiating sample analysis of a sample on a direct sample analysis sample support substantially immediately after coupling the lens assembly to the external surface of the adapter. In other embodiments, the method comprises maintaining a substantially constant vacuum pressure in the mass spectrometer during the coupling of the adapter.

In another aspect, a method of coupling a direct sample analysis device to a mass spectrometer, the method comprising coupling an adapter comprising a coupler sized and arranged to engage to a capillary inlet of the mass spectrometer to provide fluidic coupling between the capillary inlet and a direct sample analysis sample support to permit substantially immediate sample analysis of sample on the direct sample analysis sample support after coupling of the adapter is provided.

In certain embodiments, the adapter comprises an internal sleeve, an external sleeve and an insulator between the internal sleeve and the external sleeve. In other embodiments, the method comprises maintaining an operating pressure of the mass spectrometer during coupling of the coupler to the capillary inlet. In further embodiments, the method comprises coupling a lens assembly to the coupled adapter and initiating the sample analysis substantially immediately subsequent to coupling of the lens assembly. In some examples, the method comprises configuring the adapter to comprise a separate internal coupler and a separate external coupler.

In another aspect, the adapters described herein can be packaged in the form of a kit that comprises one or more of the adapters described herein. In other embodiments, the kit may comprise two or more of the adapters described herein.

Other aspects and attributes will become apparent to those skilled in the art after review of the detailed description and accompanying drawings.

BRIEF DESCRIPTION OF FIGURES

Certain configurations are provided below for illustrative purposes only with reference to the accompanying figures in which.

Figure 1:
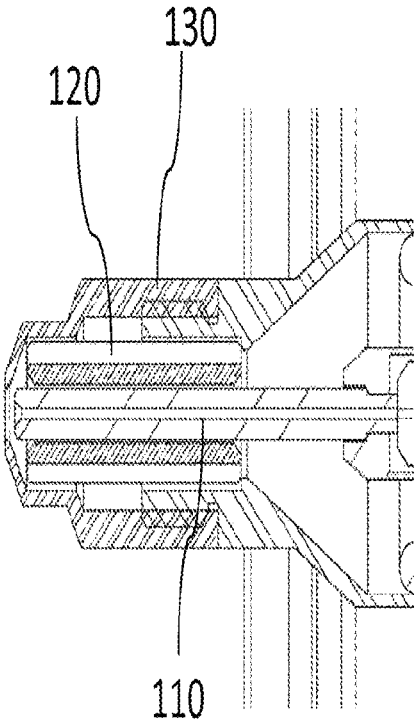
FIG. 1 is an illustration of an adapter comprising an internal coupler and an external coupler, in accordance with certain examples.

Additional features, aspects and embodiments are described in more detail below. It will be recognized by the person of ordinary skill in the art, given the benefit of this disclosure, that the lengths and dimensions shown in the figures are not limiting and that many different lengths and dimensions can be used depending on the size of the adapter, the system which the adapter is to be used in and other factors.

DETAILED DESCRIPTION

Certain embodiments of adapters are described below can include one or more components that can facilitate fluidic coupling of a direct sample analysis device to an inlet of a mass spectrometer or other analytical instrument that can receive a fluid stream. The exact configuration of the adapters including, for example, the length and width of the adapter components, size and configuration of the openings of the adapters and materials used in the adapters, or components thereof, can vary depending on the particular instrument the adapters are to be used with and/or depending on the nature of the sample to be analyzed. Where direct sample analysis is referred to below, no particular configuration of a direct sample analysis device or system is intended to be required as being necessary for properly using the adapters. For illustration purposes, some configurations of a direct sample analysis device or system are described herein. The term sample support, as used in certain instances herein, refers to a holder, device or other structure that is effective to retain a sample, for at least some period, to permit analysis of the sample. In some instances, the sample support may be configured to receive a mesh, screen or other material that is effective to receive and retain a sample for analysis.

In certain examples, the adapters described herein can be configured to slip onto a fluid inlet of an analytical device to permit coupling of one or more other components to the adapter. For example, the adapter can be sized and arranged to permit a lens assembly to be placed over the adapter while permitting fluidic coupling of a sample support to the fluid inlet. In embodiments where the fluid inlet is part of a mass spectrometer, the adapter can permit coupling of the direct sample analysis device without breaking the vacuum of the mass spectrometer. In certain embodiments, a mass spectrometer may have an operating pressure of about $10^{-9}$ Torr or less. Where existing sample introduction systems are coupled to the mass spectrometer, the vacuum seal is broken requiring pumping of the instrument back down to operating pressure and a substantial delay, e.g., about 8 hours or more, before sample can be analyzed. In addition, where capillary inlets are present, it is often required that the existing capillary be removed and replaced with a longer capillary. Replacement of the capillary with a longer one often requires removal of the source block and subsequent realignment before the instrument may be used. In certain embodiments of the adapters described herein, a direct sample analysis device can be coupled to a mass spectrometer without removal of the source block. In other embodiments of the adapter described herein, a direct sample analysis device can be coupled to a mass spectrometer without lengthening of the capillary of the capillary inlet. In further embodiments of the adapter described herein, a direct sample analysis device can be coupled to a mass spectrometer without breaking of the vacuum of the mass spectrometer. In other embodiments, the adapter is configured to permit coupling of the direct sample analysis device without removing any lenses of the mass spectrometer.

In certain embodiments, an adapter comprising an internal coupler and an external coupler can be used to fluidically couple a direct sample analysis device to an analytical instrument, e.g., a mass spectrometer. Referring to FIG. 1, an adapter is shown comprising an internal coupler 110 and an external coupler 120. The exact configuration of the internal coupler can vary, and in some examples the internal coupler is configured to permit fluidic coupling from the outside of the adapter to a capillary inlet of the analytical system. For example, the internal coupler 110 can be configured to engage a capillary inlet of the mass spectrometer such that sample from a sample support can be provided to the capillary inlet. In some embodiments, the external coupler 120 can be sized and arranged to engage another component of the analytical instrument such as, for example, a direct sample analysis lens assembly 130. In certain embodiments, the internal coupler 110 and the external coupler 120 are integral to the adapter, e.g., the adapter is a one-piece adapter. In use of a one-piece adapter, an end cap is typically removed from the capillary inlet, and the adapter is slid onto the capillary inlet in place of the end cap. The lens assembly 130, or other component, may be slid or placed over the adapter to prepare the instrument for sample analysis. In some examples, the internal coupler 110 and the external coupler 120 are two separate components which may engage each other in a suitable manner to provide the fluidic coupling. For example, the internal coupler 110 may first be slid or placed onto the capillary inlet followed by placement of the external coupler 120 over the internal coupler 110. The lens assembly 130 may be placed over the external coupler 120 to permit use of the direct sample analysis device with the instrument for sample analysis.

Figure 2:
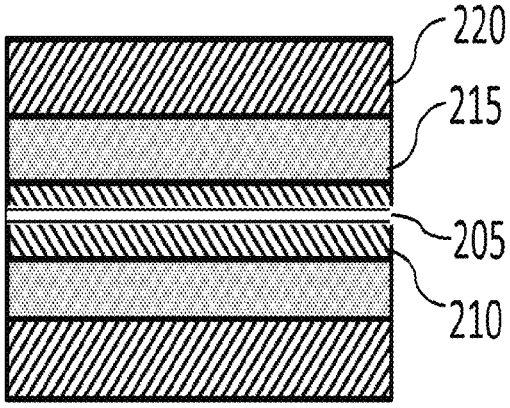
FIG. 2 is an illustration of an adapter comprising an internal coupler, an external coupler and an insulator between the internal coupler and the external coupler, in accordance with certain examples.

In certain examples, the internal coupler 110 and the external coupler 120 may be placed in direct contact with each other without any intervening component or device between them. In other embodiments, the internal coupler 110 and the external coupler 120 can be separated by one or more other components, e.g., a spacer or insulator. For example, a spacer can be placed between the internal coupler 110 and the external coupler 120 in instances where the internal diameter of the external coupler 120 is larger than the outer diameter of the internal coupler 110. Use of a spacer can permit physical contact of the internal coupler 110 and external coupler 120 through the spacer to provide electrical coupling between the coupler 110 and the coupler 120. In other embodiments, it may be desirable to electrically decouple the internal spacer 110 and the external spacer 120. For example and referring to FIG. 2, an adapter comprises an internal coupler 210 comprising a capillary channel 205. The adapter also includes an external coupler 220 configured to permit coupling of a lens assembly (not shown) to the mass spectrometer. The adapter also comprises an insulator 215 which is effective to electrically decouple the external coupler 220 and any installed lens assembly from the internal coupler 210. In some embodiments, the insulator 220 may be a separate component that is coupled to the internal coupler 210 prior to coupling of the external coupler 220. In other embodiments, the insulator 220 may be integral to the internal coupler 210 such that coupling of the internal coupler 210 to the capillary inlet acts to suitably position the insulator 215 between the internal coupler 210 and the external coupler 220. In other examples, the insulator 215 may be integral to the external coupler 220 such that coupling of the external coupler 220 to the internal coupler 210 acts to suitably position the insulator 215 between the internal coupler 210 and the external coupler 220. It may be desirable to electrically decouple the internal coupler 210 from the external coupler 220 such that no unwanted electrical fields are provided. For example, the lens assembly that is coupled to the external coupler 220 may be electrically charged to assist in entry of only certain ions or atoms into the capillary inlet. It may be desirable to prevent the charge on the lens assembly from reaching the internal coupler 210. The insulator 215 can be effective to electrically isolate the internal coupler 210 from the external coupler 220 and/or any lens assembly.

In certain embodiments, the internal coupler 210 is configured to engage the capillary inlet through a friction fit, whereas in other embodiments the internal coupler 210 can couple to the capillary inlet through threads or other fittings. In some embodiments, the internal coupler 210 can be sized and arranged to center the capillary inlet within the internal coupler 210 to provide a fluid flow path at a desired angle or plane. In some examples, the external coupler 220 may couple to the internal coupler 210 through a friction fit or through the use of threads or fittings. Similarly, the external coupler 220 can engage the lens assembly through a friction fit or through threads or other fittings. Where an insulator 215 is present, it can engage the internal coupler 210 and/or external coupler 220 through a friction fit or through threads or other fittings. In some embodiments, the insulator 215 may be produced from, or may include, any non-conductive material including, but not limited to, ceramics such as, for example, alumina, yttria, titania or mixtures thereof. As described herein, the internal and external couplers can produced with one or more substantially inert materials such as, for example, the plastics and/or stainless steel materials described herein.

In certain examples, the external surface of the internal coupler 210 can be configured as non-conductive, e.g., can include a non-conductive coating or layer that physically contacts an inner surface of the external coupler 220. In other embodiments, the internal surface of the external coupler 220 can be configured as non-conductive, e.g., can include a non-conductive coating or layer that physically contacts an outer surface of the internal coupler 210. If desired, the internal surface of the internal coupler 210 may comprises a non-conductive material or a substantially inert material, either of which can take the form of a coating or layer, to reduce the likelihood of sample contamination by the internal coupler 210. In some embodiments, the internal surface of the internal coupler 210 can be concentric and sized and arranged to center the capillary inlet within the internal coupler 210. For example, it may be desirable to align the center of the capillary inlet with the center of the adapter inlet to ensure ions traveling into the adapter inlet are provided to the capillary inlet without hitting the internal surfaces of the adapter inlet. In certain examples, the adapter need not perfectly center the capillary inlet but can place the capillary inlet substantially in the center of the adapter.

Figure 3:
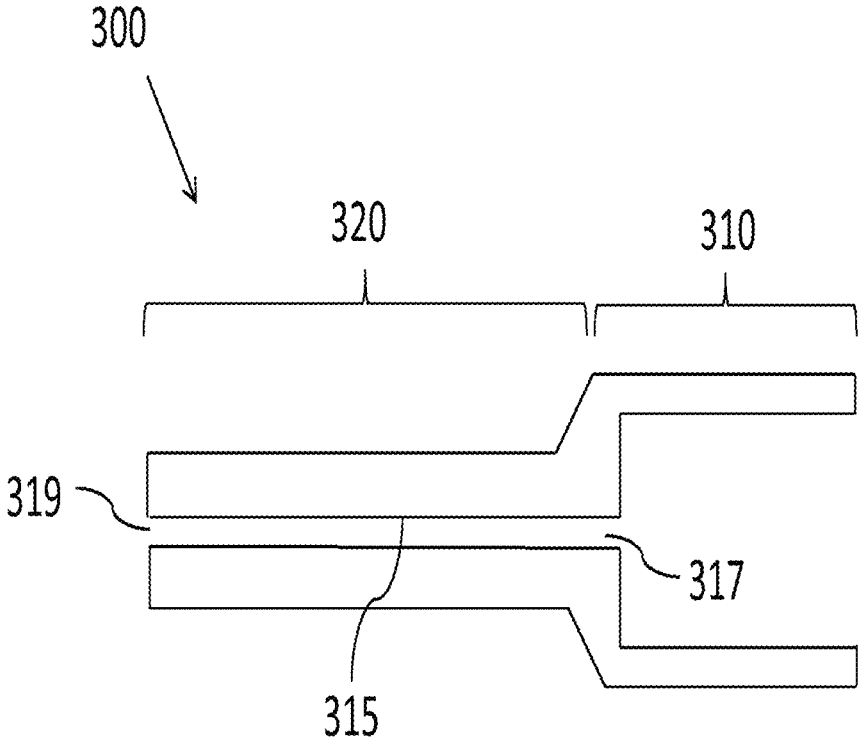
FIG. 3 is an illustration of a capillary sleeve, in accordance with certain examples.
Figure 4:
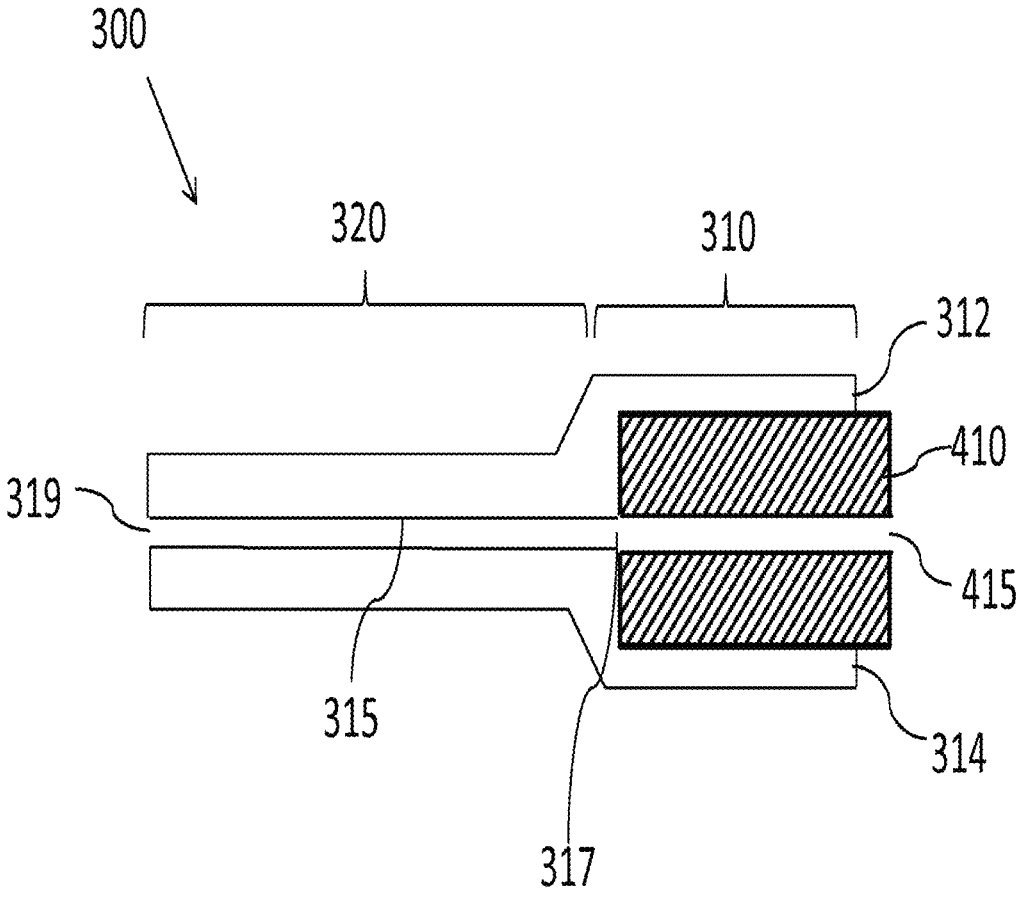
FIG. 4 is an illustration of the capillary sleeve of FIG. 3 coupled to a capillary housing, in accordance with certain examples.

In certain embodiments, an adapter comprising a capillary sleeve and an end cap extension can be used to install a direct sample analysis device on a mass spectrometer. Referring to FIG. 3, a capillary sleeve 300 is shown as including a generally cylindrical body with a first portion 310 and a second portion 320. The sleeve 300 comprises an internal channel 315 that can fluidically couple to the capillary inlet of the mass spectrometer at an end 317. The other end 319 of the channel 315 may be fluidically coupled to a sample support (not shown) to receive sample into the channel 315. The portion 310 of the sleeve 300 can be sized and arranged to slide over and around the capillary housing until the surface of the sleeve 300 that is adjacent to the end 317 contact the capillary housing. Such contact places the end 317 proximal to the end of the capillary inlet and provides fluidic coupling between the end 319 and the capillary inlet. For example and referring to FIG. 4, a capillary housing 410 comprising a capillary 415 is shown as being coupled to the capillary sleeve 300. The surface adjacent to the opening 317 abuts the surface of the capillary housing 410. The portion 310 of the capillary sleeve can include arms or projections 312, 314 that can engage the outer surface of the capillary housing 410 to provide contact of increased surface area of the housing 410 by the inner surfaces of the capillary sleeve 300. In some embodiments, one end of the capillary sleeve 300 can be configured to couple to the capillary inlet and is pushed into the capillary housing 410 until it encounters resistance by the capillary housing 410. Placement of the sleeve 300 onto the housing 410 until resistance is encountered can provide the fluidic coupling between the ends of the capillary sleeve 300 and the capillary 415.

Figure 5:
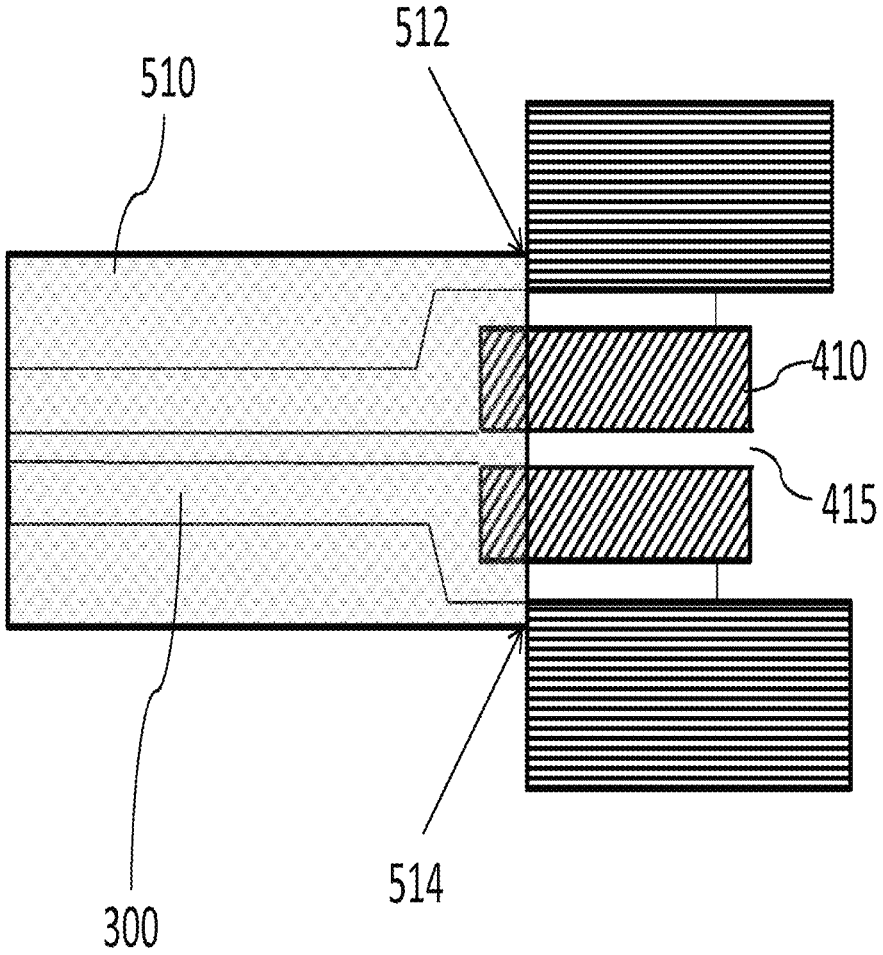
FIG. 5 is an illustration of an end cap coupled to a capillary sleeve, in accordance with certain examples.

In certain examples, an end cap extension may then be coupled to the capillary sleeve, e.g., slid onto and around the capillary sleeve. Referring to FIG. 5, an end cap extension 510 is shown as being coupled to the capillary sleeve 300. The extension 510 is slid onto the capillary sleeve 300 and engages the capillary sleeve 300 through a friction fit at the portion 320 of the capillary sleeve 300. The extension 510 is placed on the sleeve 300 and slid in a direction toward the interior of the instrument until it encounters resistance when it contacts internal surfaces of the instrument at arrows 512 and 514. Once resistance is encountered, insertion is halted and the coupled capillary sleeve 300 and extension 510 are ready for analysis or ready to be coupled to another component of the system. In certain embodiments, the end cap extension 510 can assist with the fluidic coupling between a sample holder and a mass spectrometer capillary inlet and/or may be sized and arranged to receive a lens assembly for selection of certain ions or atoms in the ionized sample. In certain examples, the end cap extension 510 is configured to slidingly engage to the capillary sleeve 300. In some embodiments, the lens assembly is configured to slidingly engage to the end cap extension 510. If desired, the components of the adapter can couple to each other through a friction fit.

Figure 6:
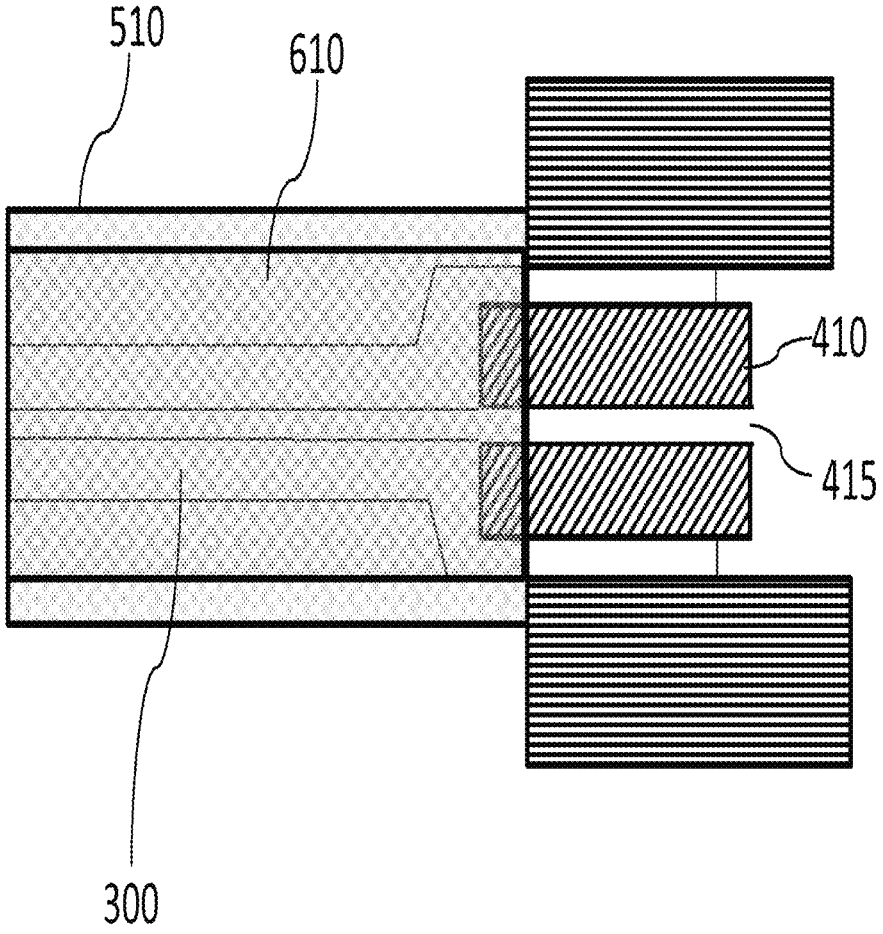
FIG. 6 is an illustration of an insulator between a coupled end cap and a capillary sleeve, in accordance with certain examples.

In certain embodiments, one or both of the capillary sleeve 300 and the end cap extension 510 can include an insulator to electrically decouple or isolate the capillary sleeve 300 from the end cap extension 510. For example and referring to FIG. 6, an insulator 610 can be coupled to the sleeve 300 prior to coupling of the end cap extension 510. Where it is desirable to use an insulator 610, the dimensions of the end cap extension 510 can be altered such that a friction fit is provided between the end cap extension 510 and the insulator 610. Without wishing to be bound by any particular scientific theory, the insulator 610 may be effective to electrically decouple the sleeve 300 from the end cap extension 510. In some analytical methods, the end cap extension 510 may include an electrical voltage or current that can be isolated from the capillary sleeve 300. In certain instances, the capillary sleeve 300 or capillary inlet may have its own voltage, which can be different than the voltage of the end cap extension 510. The insulator 610 permits independent control of the voltages on each of the sleeve 300 and the end cap extension 510. In some embodiments, the insulator 610 may be produced from, or may include, one or more nonconductive materials such as, for example, alumina or other ceramics. The end cap extension 510, the capillary sleeve 300 or both may be effective to assist in centering the capillary inlet in the adapter inlet. By centering the capillary inlet opening, more reproducible results can be achieved and overall accuracy improvements can be realized. In certain embodiments, a lens assembly (not shown) can be coupled to the end cap extension 510. In some examples, the lens assembly may be effective to select or guide certain ions into the capillary inlet, e.g., at a desired angle, and reject or deflect unwanted ions. The adapter components shown in FIGS. 3-6 can be used with additional components in other analytical systems if desired. In addition, the overall dimensions including the width, length and geometry of the components can be varied to permit fluidic coupling of a direct sample analysis device to an instrument.

Figure 7:
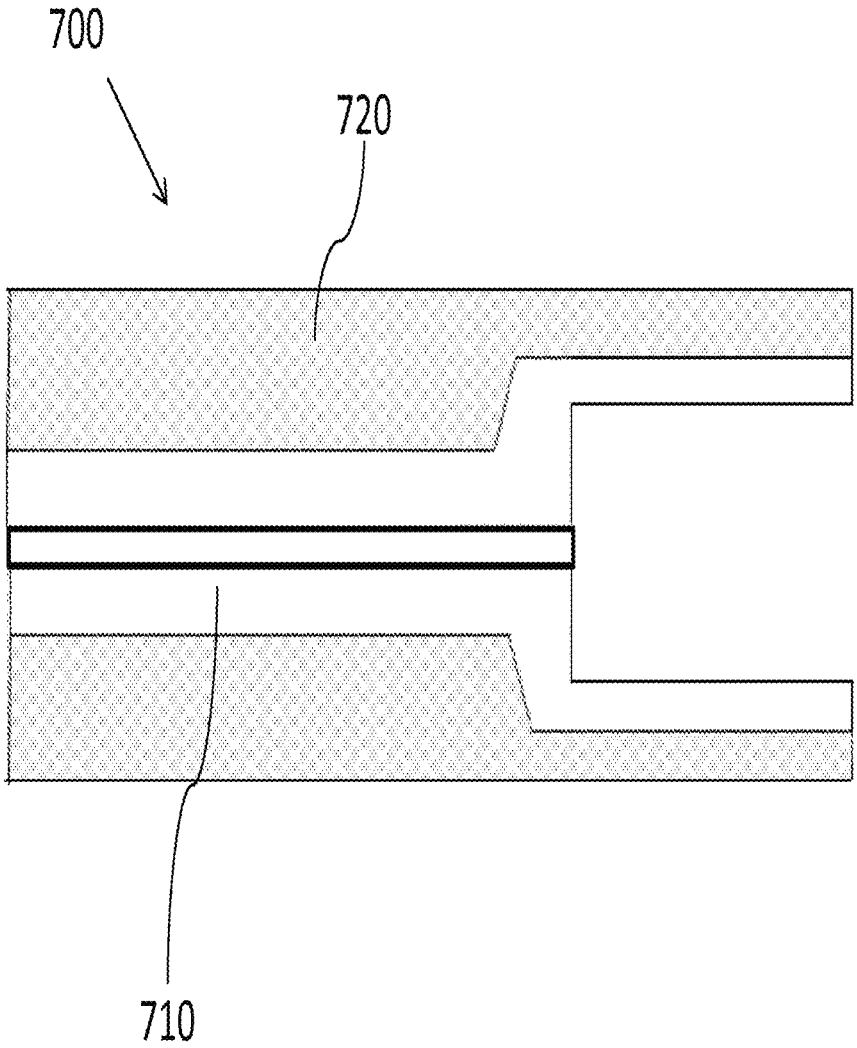
FIG. 7 is an illustration of an adapter configured as a unitary device and comprising an internal sleeve and an external sleeve, in accordance with certain examples.
Figure 8:
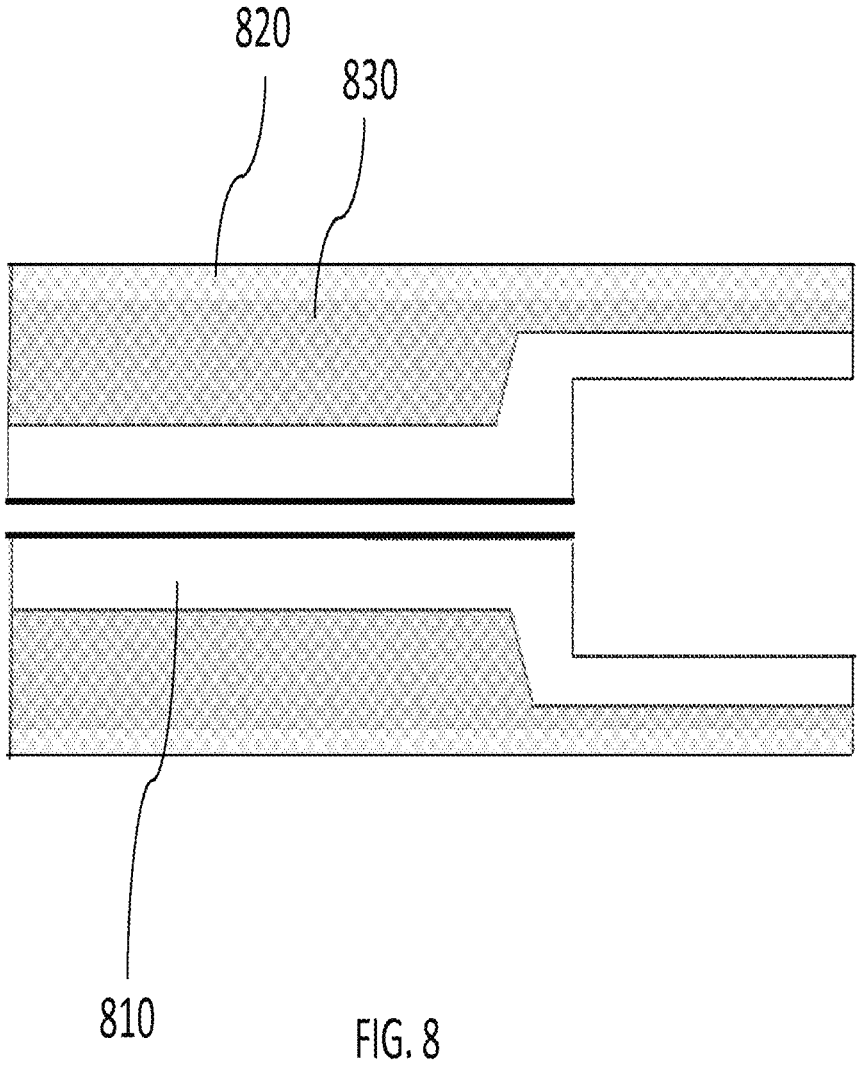
FIG. 8 is an illustration of an adapter configured as a unitary device and comprising an internal sleeve, an external sleeve and an insulating layer or sleeve between the internal sleeve and the external sleeve, in accordance with certain examples.

In certain embodiments, the adapter may be configured as a unitary device with an internal sleeve and an external sleeve. For example and referring to FIG. 7, the adapter 700 comprises an internal sleeve 710 and an external sleeve 720. The internal sleeve 710 can be configured similar to the capillary sleeve 300, e.g., can be configured to couple to a capillary housing and provide fluidic coupling between a sample support and a capillary inlet of an instrument. The external sleeve 720 can be configured similar to the end cap extension 510, e.g., can be configured to couple to a lens assembly. In some embodiments, the internal sleeve 710 may be electrically isolated from the external sleeve 720 by an insulative material between the sleeve 710 and the sleeve 720. For example and referring to FIG. 8, an insulator 830 can be present between an internal sleeve 810 and an external sleeve 820 to electrically decouple the internal sleeve 810 from the external sleeve 820. In some embodiments, the insulator 830 is configured to permit each of the internal sleeve 810 and the external sleeve 820 to receive or provide a different voltage or no voltage. Where a unitary adapter is used, an end cap of the capillary inlet can be removed and the unitary adapter may be coupled to the capillary inlet by inserting the adapter until resistance is encountered. In other configurations, the unitary adapter can include threads or other fittings to assist in retention of the adapter to the capillary inlet. After coupling of the adapter, a lens assembly may be coupled to the coupled adapter and sample analysis may be immediately initiated without having to wait for the instrument to be pumped down to a desired operating pressure.

In certain embodiments, the adapter comprising the sleeves can be configured to slidingly engage to a lens assembly, e.g., through a friction fit. In some embodiments, the sleeves may be configured as separate sleeves that can be coupled to each other through a friction fit by sliding the external sleeve over the internal sleeve. Where two or more sleeves are present, the internal sleeve, the external sleeve or both can be configured as substantially concentric sleeve that are effective to generally center the capillary inlet. In certain examples, the sleeves of the adapter can be coupled to the mass spectrometer without removing any lenses of the mass spectrometer. If desired, one or more insulating sleeves can be inserted between the internal sleeve and the external sleeve.

In some embodiments, coupling of the adapters and/or lens assemblies permit substantially immediate sample analysis to be initiated. For example, unlike existing devices that are used to couple a direct sample analysis device to an instrument, such as a mass spectrometer, which may require hours of pumping to reach an operating pressure, e.g., a vacuum pressure, the adapters described herein permit sample analysis to begin within about 30 seconds of coupling of the adapter, more particularly within about 1 minute, 2 minutes, 3 minutes, 4 minutes or about 5 minutes of coupling the adapter and/or lens assembly. In some instances, after coupling of the lens assembly, a sample support comprising sample can be loaded onto a sample platform. The sample platform with coupled sample support can be lowered and translated into a position such that one or more of the apertures of the sample support are placed between an ion source, e.g., an ion gun, and an aperture or opening of the coupled lens assembly/adapter. The ion source can impact the sample and ionized sample may exit the sample support and be provided to the capillary inlet of a mass spectrometer through the aperture of the coupled lens assembly/adapter.

Figure 9:
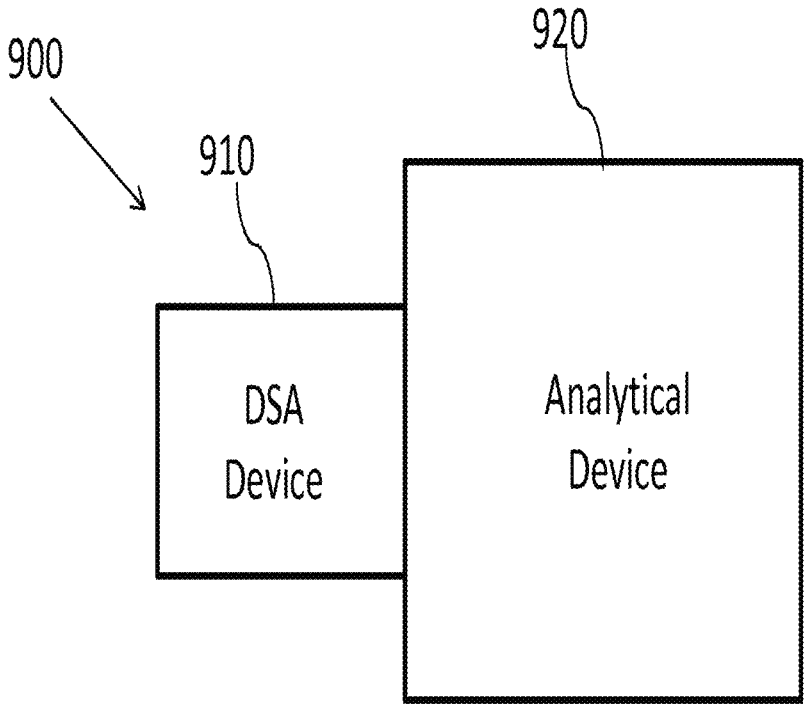
FIG. 9 is a block diagram of an instrument comprising a direct sample analysis device, in accordance with certain examples.
Figure 10A:
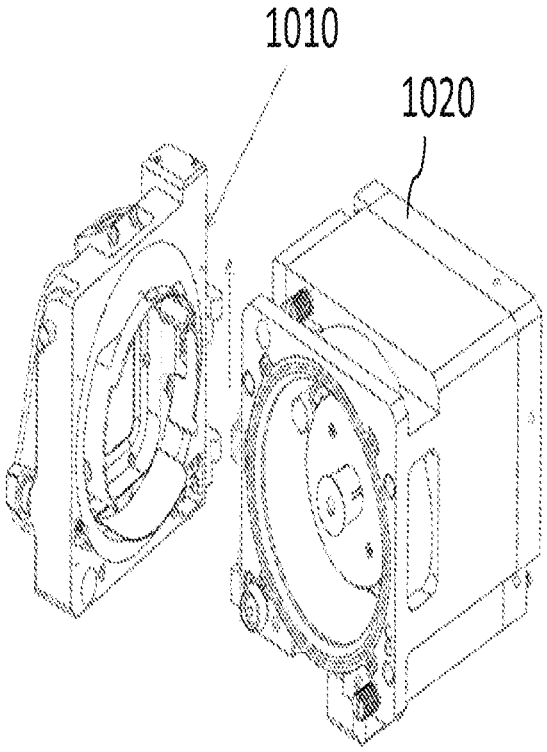
FIGS. 10A-10D schematically show installation of an adapter and lens assembly on a mass spectrometer, in accordance with certain examples.
Figure 10B:
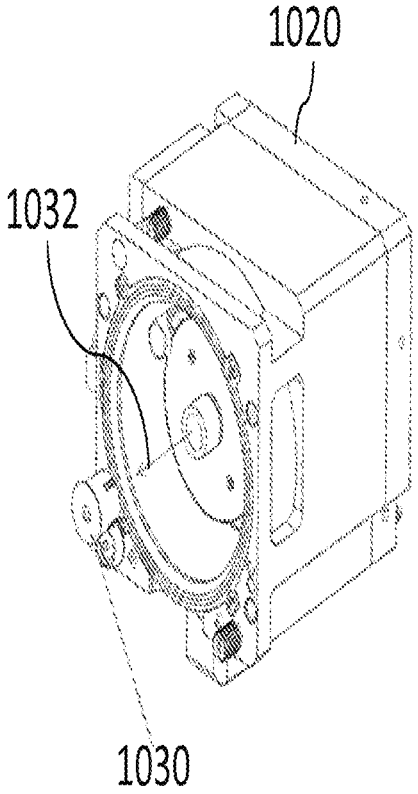
Figure 10C:
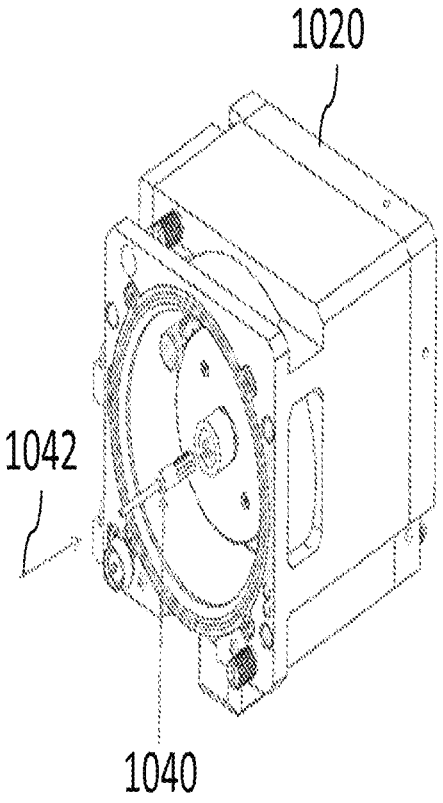
Figure 10D:
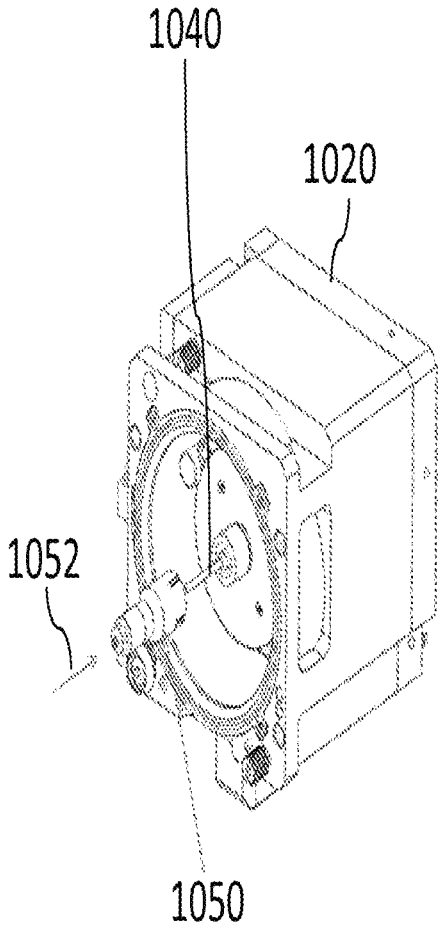

In certain embodiments, a system for performing direct sample analysis can include one of the adapters described herein. Referring to FIG. 9, a system 900 comprising a direct sample analysis (DSA) device 910 coupled to an analytical device 920 is shown. The DSA device 910 may be fluidically coupled to the analytical device 920 and/or physically coupled to the analytical device 920. In certain embodiments, the analytical device 920 may take many forms including mass spectrometers, optical absorbance or emission detectors, plasma based analytical systems or other systems. In direct sample analysis, the sample can be directly analyzed without undergoing pre-sample preparation or purification, e.g., without being subjected to one or more purification steps, chromatographic separation steps or the like. In a typical operation, the sample is ionized after collision with an energized ion or atom, e.g., an electronically excited ion or atom. The collisional atoms are typically provided by an ion source such as, for example, an electron ionization source, a chemical ionization source, an electrospray ionization source, an atmospheric-pressure chemical ionization source, a plasma (e.g., inductively coupled plasma), glow discharge sources, field desorption sources, fast atom bombardment sources, thermospray sources, desorption/ionization on silicon sources, secondary ion mass spectrometry sources, spark ionization sources, thermal ionization sources, ion attachment ionization sources, photoionization or other suitable ion sources. Energy transfer can occur between excited molecules from the ion source and the sample which can cause ejection of charged sample species from the sample support. The ejected species may be provided to the analytical device 920 or system, e.g., a mass analyzer, for detection. In a typical setup, the ions which are provided to the analytical device 920 pass through an interface (not shown) which may include one or more ion guides or lenses to select an analyte of a desired mass-to-charge ratio and/or remove any interfering or unwanted species.

In certain embodiments where the analytical device 920 takes the form of a mass spectrometer, many different types of mass analyzers can be used with the sample support holders described herein. For example, sector field mass analyzers, time of flight mass analyzers, quadrupole mass filters, ion traps, linear quadrupole ion traps, orbitraps or cyclotrons, e.g., Fourier transform ion cyclotron resonance or other suitable mass analyzers can be used. As selected ions exit the mass analyzer they can be provided to a detector to detect a change in charge or a current that is produced as the ions impact or travel by a surface, for example. Illustrative detectors include, but are not limited to, electron multipliers, Faraday cups, ion-to-photon detectors, microchannel plate detectors, an inductive detector or other suitable detectors may be used. The mass spectrometer typically will include a display that can provide a spectrum for review by the user. While not described, the mass spectrometer typically would include numerous other components including a vacuum system, one or more interfaces and many other components commonly found in mass spectrometers in use.

In some embodiments, the system 900 can include the DSA device 910 and an adapter for installing the DSA device on a mass spectrometer. In some embodiments, the adapter comprises a capillary sleeve configured to couple to a capillary inlet of the mass spectrometer, and an end cap extension configured to couple to the capillary sleeve, in which the capillary sleeve and end cap extension are configured to provide fluidic coupling between a sample support of the DSA device 910 and the mass spectrometer through the capillary inlet. In certain examples, the end cap extension used in the system 900 can be configured to couple to a lens assembly. In some examples, the lens assembly can be configured to slidingly engage to the end cap extension. In other examples, the end cap extension can be configured to slidingly engage to the capillary sleeve. In some embodiments, the capillary sleeve couples to the capillary inlet through a friction fit. In certain instances, the end cap extension couples to the capillary sleeve through a friction fit. In certain examples, the capillary sleeve comprises an insulator configured to electrically decouple the capillary sleeve from the end cap extension. In other embodiments, the capillary sleeve is further configured to center the capillary inlet. In some examples, the end cap extension comprises an insulator configured to electrically decouple the capillary sleeve from the end cap extension. In further example, the end cap extension is further configured to center the capillary inlet.

In other embodiments, the DSA device 910 can include an adapter comprising an internal sleeve configured to couple to a capillary inlet of the mass spectrometer, an external sleeve coupled to the internal capillary sleeve, and an insulator between the internal sleeve and the external sleeve to electrically decouple the internal sleeve from the external sleeve, in which the adapter is configured to provide fluidic coupling between a sample support and the mass spectrometer through the capillary inlet. In some examples, the external sleeve of the adapter used in the system 900 can be configured to couple to a lens assembly. In certain examples, the lens assembly can be configured to slidingly engage to the external sleeve of the adapter. In other embodiments, the external sleeve can be configured to slidingly engage to the internal sleeve. In some examples, the internal sleeve couples to the capillary inlet through a friction fit. In some embodiments, the external sleeve couples to the internal sleeve through a friction fit. In additional examples, the internal sleeve can be sized and arranged to center the capillary inlet in the internal sleeve. In some examples, the insulator comprises at least one ceramic material. In other examples, the adapter can be configured to permit coupling of the direct sample analysis device while maintaining a vacuum of the mass spectrometer. In some examples, the adapter can be configured to permit coupling of the direct sample analysis device without removing any lenses of the mass spectrometer.

In certain examples, the adapter of the system 910 may comprise an adapter for installing a direct sample analysis device on a mass spectrometer without breaking the vacuum of the mass spectrometer. For example, the adapter may comprises a coupler sized and arranged to engage to a capillary inlet of the mass spectrometer and comprising an internal surface configured to engage to the capillary of the capillary inlet and an external surface electrically isolated from the internal surface through an insulator. In some embodiments, the adapter can be configured to provide fluidic coupling between a sample support, e.g., a DSA sample support, and the mass spectrometer through the capillary inlet. In some embodiments, the external surface of the coupler can be configured to couple to the lens assembly through a friction fit. In other embodiments, the internal surface engages the capillary inlet through a friction fit. In certain examples, the internal surface is concentric, e.g., it may be sized and arranged to center the capillary inlet within the adapter. In some embodiments, the insulator comprises at least one ceramic material. In other embodiments, the ceramic material is one of alumina, yttria, titania or mixtures thereof. In further examples, each of the external surface and the internal surface comprises a substantially inert material. In some examples, the substantially inert material is a stainless steel. In other embodiments, the adapter is configured to permit coupling of the direct sample analysis device while maintaining a vacuum of the mass spectrometer. In some embodiments, the adapter is configured to permit coupling of the direct sample analysis device without removing any lenses of the mass spectrometer.

In certain embodiments, the adapters described herein can be used to permit exchange of an existing ionization device in a mass spectrometer with a direct sample analysis device. For example, one or more ionization systems commonly used in a mass spectrometer can be removed and replaced with a direct sample analysis device. Illustrative types of ionization devices that can be replaced with a direct sample analysis device include, but are not limited to, devices including a source selected from an electron ionization source (ESI), a chemical ionization source, an electrospray ionization source, an atmospheric-pressure chemical ionization source, a plasma (e.g., inductively coupled plasma), glow discharge sources, field desorption sources, fast atom bombardment sources, thermospray sources, desorption/ionization on silicon sources, secondary ion mass spectrometry sources, spark ionization sources, thermal ionization sources, ion attachment ionization sources, photoionization or other suitable ion sources. Referring to FIGS. 10A-10D, a series of figures are shown pictorially representing the process of replacing an electrospray ionization source of a mass spectrometer with a direct sample analysis device. The ESI door assembly 1010 (see FIG. 10A) is removed from the mass spectrometer 1020 by opening the ESI door 1010 and lifting the door 1010 upward. A nozzle cap 1030 (see FIG. 10B) is then removed by grasping the nozzle cap 1030 and moving it away from the capillary housing in the general direction of arrow 1032. An adapter 1040 is then coupled to the capillary housing (see FIG. 10C) by inserting the adapter 1040 in the direction of arrow 1042 until it encounters resistance from the capillary housing. A lens assembly 1050 (see FIG. 10D) can then be installed over the adapter 1040 in the direction of arrow 1052. The adapter 1040 may be any of the adapters described herein. For example, the adapter can be configured with capillary extension and an end cap extension that is coupled capillary extension. If desired, an insulator can be placed between the capillary extension and the end cap extension. In other embodiments, the adapter can include and internal sleeve and an external sleeve that can couple to the internal sleeve. Optionally an insulator may be between the internal and external sleeves. Adapters comprising other configurations may also be used to permit coupling of a lens assembly of a direct sample analysis device to a mass spectrometer.

Figure 11:
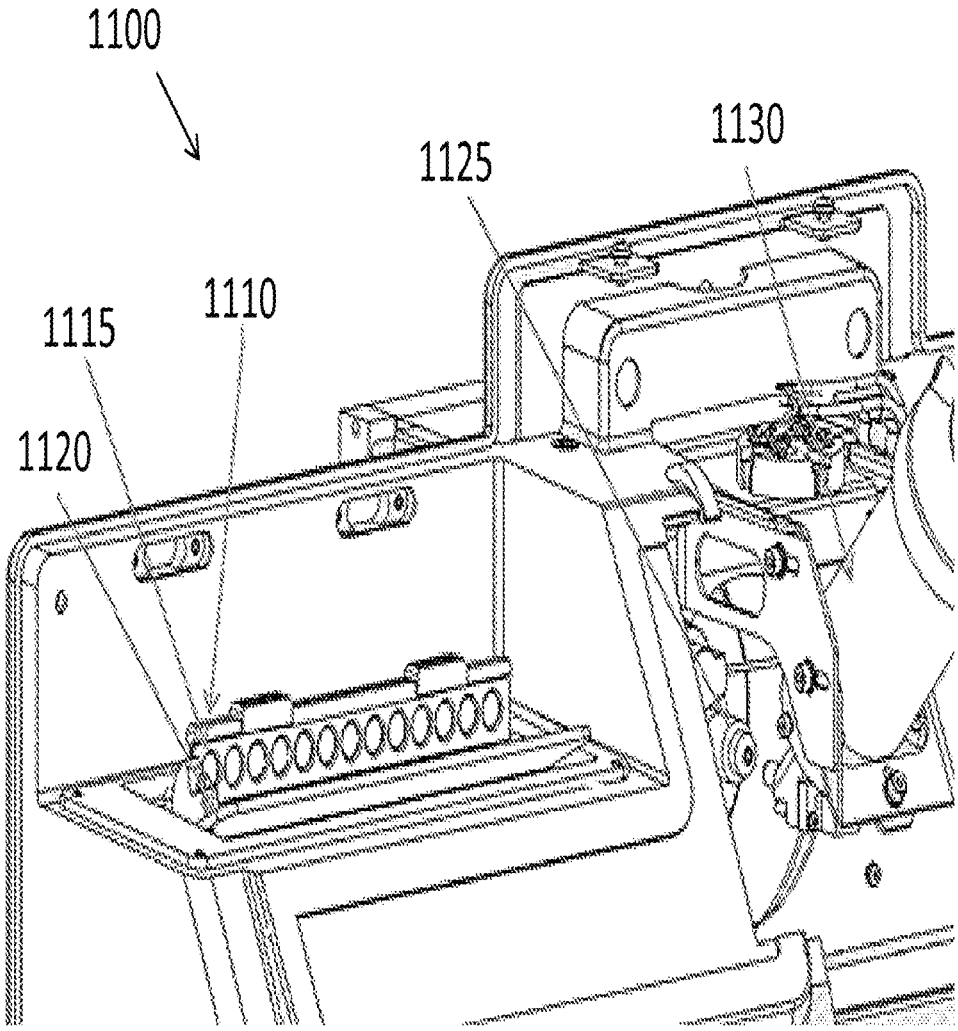
FIG. 11 is an illustration of a direct sample analysis device coupled to a mass spectrometer, in accordance with certain examples.
Figure 12:
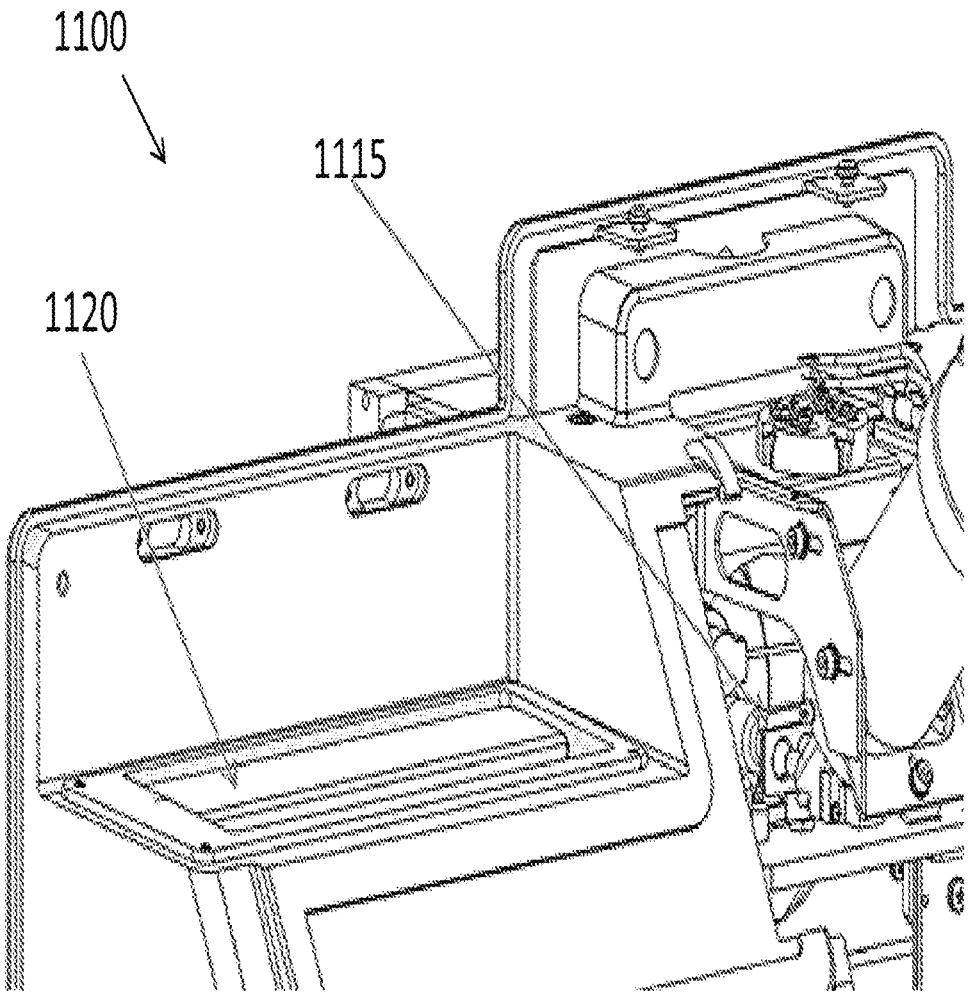
FIG. 12 is an illustration of a the system of FIG. 11 showing the sample support between an ion gun and a lens assembly, in accordance with certain examples.

In certain embodiments, once the lens assembly is installed, the system is ready to analyze sample by direct sample analysis. Referring to FIG. 11, a cut away view of a direct sample analysis device 1100 is shown. The DSA device 1100 includes a sample holder assembly 1110 including a sample support 1115 coupled to a sample platform. A sealing device 1120, e.g., a door or cover, is shown as being present in an open position to permit loading of the sample support 1115 onto the sample platform. The DSA device 1100 also comprises a lens assembly 1125, which is similar to, or the same as, the lens assembly 1050 of FIG. 10D, and an ion source or ion gun 1130. Referring also to FIG. 12, once the sample support 1115 is loaded onto the sample platform, the sample platform is lowered into the DSA device 1100 and moved toward the right of the figure to align one of the apertures of the sample support 1115 with the ion gun 1130 and the lens assembly 1125. Ions from the ion gun 1130 impact the sample on the sample support 1115, and ionized sample exits the sample support on an opposite side of the sample support 1115 and enters the lens assembly 1125. The lens assembly 1125 is fluidically coupled to the analytical device through an adapter (not shown), as described herein, to provide ionized sample from the DSA device to the analytical device, e.g., to the mass spectrometer through a capillary inlet of the mass spectrometer.

In a typical sampling operation, the sample can be added to the sample support, e.g., either directly or by suspending the sample in a liquid or dissolving the sample in a solvent, where it is retained at least for a sufficient period to permit analysis of the sample. Where the sample is a solid, it may be crushed, pulverized, homogenized or otherwise rendered into powder or crystalline form to be loaded onto the sample support. A diluent or carrier can be added to the powder to clump or agglomerate the powder to facilitate loading onto the sample support. Where diluents or carriers are used, suitable materials are selected so they do not create species that may interfere with any analysis of the sample. Where the sample is a liquid, it may be sprayed on, dropped on, pipetted on or otherwise introduced onto the sample support. In some embodiments, the sample support can be dipped into a liquid or liquids to load the samples onto the sample support. For example, the sample support can be configured with individual sections that are separated by openings and configured to be dipped or disposed into an individual receptacle, e.g., an individual microwell, to permit dipping of the sample support into a plurality of wells in a microwell plate. Such sample supports would permit automated sample loading and decrease the overall time needed to load samples onto the sample support.

In certain embodiments, the adapters and components of the adapters described herein can be produced using one or more suitable materials that are generally inert so as to not substantially interfere with, or contaminate, any sample analysis. In some embodiments, the materials may be, or may include, one or more plastic materials including thermoplastics and thermosets. In some embodiments, the plastic material desirably has a melting temperature of greater than 250 degrees Celsius, more particularly greater than 300 degrees Celsius. In certain embodiments, any one or more of the adapter components herein can include a thermoplastic comprising an acrylic polymer, a fluoroplastic polymer, a polyoxymethylene polymer, a polyacrylate polymer, a polycarbonate polymer, a polyethylene terephthalate polymer, a polyester polymer, a polyetheretherketone polymer, a polyamide polymer, a polyimide polymer, a polyamide-imide polymer, a polyaryletherketone polymer or combinations and copolymers thereof. If desired metallic or conductive particles can be included in the thermoplastic to facilitate electrical coupling of the sample support to an electrical ground. In some embodiments, the thermoplastic used is substantially transparent when viewed with the human eye to facilitate, for example, coupling of the adapter to the capillary housing. In certain embodiments, the components of the adapters can be produced using one or more substantially inert metal materials including, for example, Inconel® alloys, titanium and titanium alloys, aluminum and aluminum alloys, stainless steels, refractories or other suitable materials that include metals and which are substantially inert in the use environment of the adapters.

In certain embodiments, some components of adapters can be produced using materials other than inert materials if desired. For example, portions of the adapters may generally be out of the fluid stream that contacts the sample and can be produced using materials other than non-inert materials. If desired, the different components of the adapters can be produced using different materials. Where an insulator is present in the adapters to electrically isolate the internal coupler or sleeve from the external coupler or sleeve, the insulator may be any nonconductive material and is desirably a substantially inert nonconductive material to avoid any contamination of the sample. Illustrative insulating materials include non-conductive materials, ceramics such as, for example, alumina, yttria, titania, machinable ceramics, non-machinable ceramics or other suitable ceramics and other suitable insulating materials. In some embodiments, the components of the adapters described herein can include a material that can withstand a cleaning operation such as, for example, sonication, solvent washes or other cleaners can be used to clean and/or remove any residue from the adapters prior to reuse. In some configurations, the materials of the adapters can withstand such washing steps and substantially no deterioration occurs after washing.

In certain embodiments, the adapters, or components of the adapters, described herein can be packaged or grouped into a kit. In some examples, a kit comprises an adapter comprising a capillary sleeve configured to couple to a capillary inlet of the mass spectrometer, and an end cap extension configured to couple to the capillary sleeve, in which the capillary sleeve and end cap extension are configured to provide fluidic coupling between a sample holder and the mass spectrometer through the capillary inlet. In other examples, a kit comprises an adapter comprising an internal sleeve configured to couple to a capillary inlet of the mass spectrometer, an external sleeve coupled to the internal capillary sleeve, and an insulator between the internal sleeve and the external sleeve to electrically decouple the internal sleeve from the external sleeve, in which the adapter is configured to provide fluidic coupling between a sample holder and the mass spectrometer through the capillary inlet. In some embodiments, a kit comprises an adapter comprising an internal coupler configured to engage a capillary inlet of the mass spectrometer, an external coupler sized and arranged to engage a direct sample analysis lens assembly, and an insulator between the internal coupler and the external coupler to electrically decouple the internal coupler and the external coupler, in which the adapter is configured to provide fluidic coupling between a sample holder and the mass spectrometer through the capillary inlet. In other examples, a kit comprises a coupler sized and arranged to engage to a capillary inlet of the mass spectrometer, the coupler comprising an internal surface configured to engage to the capillary of the capillary inlet and an external surface electrically isolated from the internal surface through an insulator, in which the adapter is configured to provide fluidic coupling between a sample holder and the mass spectrometer through the capillary inlet. If desired, the kit can include two or more different adapters that can be used to couple a direct sample analysis device to an analytical instrument such as a mass spectrometer.

In certain examples, a method of installing a direct sample analysis device on a mass spectrometer while maintaining a vacuum in the mass spectrometer is provided. In certain embodiments, the method comprises coupling a capillary extension to the capillary inlet, and coupling an end cap extension to the coupled capillary extension, in which the coupled capillary extension and coupled capillary end cap are configured to provide fluidic coupling between a direct sample analysis sample support and the mass spectrometer through the capillary inlet. In some examples, the method comprises removing a capillary nozzle cap prior to coupling the capillary extension to the capillary inlet. In certain embodiments, the method comprises coupling a direct sample analysis lens assembly to the coupled end cap extension. In additional embodiments, the end cap extension comprises an insulator configured to electrically isolate the capillary extension from the end cap extension. In further embodiments, the capillary extension comprises an insulator configured to electrically isolate the capillary extension from the end cap extension.

In certain embodiments, the method comprises coupling an internal sleeve to a capillary inlet of the mass spectrometer, and coupling an external sleeve to the coupled internal capillary sleeve, the external sleeve comprising an insulator configured to be positioned between the internal capillary sleeve and the external sleeve to electrically isolate the internal sleeve from the external sleeve, in which the coupled internal and external sleeves are configured to provide fluidic coupling between a direct sample analysis sample support and the mass spectrometer through the capillary inlet. In some examples, the method comprises removing a capillary nozzle cap prior to coupling the internal sleeve to the capillary inlet. In other examples, the method comprises coupling a lens assembly to the coupled external sleeve. In additional examples, the external sleeve comprises an insulator configured to electrically isolate the internal sleeve from the external sleeve. In some embodiments, the internal sleeve comprises an insulator configured to electrically isolate the internal sleeve from the external sleeve.

In some examples, the method comprises coupling an adapter comprising a coupler sized and arranged to engage to a capillary inlet of the mass spectrometer, the coupler comprising an internal surface configured to engage to the capillary of the capillary inlet and an external surface electrically isolated from the internal surface through an insulator, in which the adapter is configured to provide fluidic coupling between a sample support and the mass spectrometer through the capillary inlet. In certain examples, the method comprises removing a capillary nozzle cap prior to coupling the internal surface to the capillary inlet. In other examples, the method comprises coupling a lens assembly to the coupled external surface. In additional embodiments, the method comprises initiating sample analysis of a sample on a direct sample analysis sample support substantially immediately after coupling the lens assembly to the external surface of the adapter. In additional embodiments, the method comprises maintaining a substantially constant vacuum pressure in the mass spectrometer during the coupling of the adapter.

In certain embodiments, a method of coupling a direct sample analysis device to a mass spectrometer is disclosed. In certain examples, the method comprises coupling an adapter comprising a coupler sized and arranged to engage to a capillary inlet of the mass spectrometer to provide fluidic coupling between the capillary inlet and a direct sample analysis sample support to permit substantially immediate sample analysis of sample on the direct sample analysis sample support after coupling of the adapter. In certain examples, the adapter comprises an internal sleeve, an external sleeve and an insulator between the internal sleeve and the external sleeve. In some embodiments, the method comprises maintaining an operating pressure of the mass spectrometer during coupling of the coupler to the capillary inlet. In other embodiments, the method comprises coupling a lens assembly to the coupled adapter and initiating the sample analysis substantially immediately subsequent to coupling of the lens assembly. In certain examples, the method comprises configuring the adapter to comprise a separate internal coupler and a separate external coupler.

When introducing elements of the aspects, embodiments and examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

The invention claimed is:

1. A method of installing a direct sample analysis device on a mass spectrometer while maintaining a vacuum in the mass spectrometer, the method comprising:

coupling a capillary extension to the capillary inlet, in which the capillary extension is configured to couple to the capillary inlet through a friction fit between outer surfaces of the capillary inlet and inner surfaces of the capillary extension; and coupling an end cap extension to the coupled capillary extension, in which the coupled capillary extension and coupled capillary end cap are configured to provide fluidic coupling between a direct sample analysis sample holder and the mass spectrometer through the capillary inlet.

2. The method of claim 1, further comprising removing a capillary nozzle cap prior to coupling the capillary extension to the capillary inlet.

3. The method of claim 1, further comprising coupling a direct sample analysis lens assembly to the coupled end cap extension.

4. The method of claim 1, in which the end cap extension comprises an insulator configured to electrically isolate the capillary extension from the end cap extension.

5. The method of claim 1, in which the capillary extension comprises an insulator configured to electrically isolate the capillary extension from the end cap extension.

6. A method of installing a direct sample analysis device on a mass spectrometer while maintaining a vacuum in the mass spectrometer, the method comprising:

coupling an internal sleeve to a capillary inlet of the mass spectrometer through a friction fit between inner surfaces of the internal sleeve and outer surfaces of the capillary inlet; and coupling an external sleeve to the coupled internal capillary sleeve, the external sleeve comprising an insulator configured to be positioned between the internal capillary sleeve and the external sleeve to electrically isolate the internal sleeve from the external sleeve, in which the coupled internal and external sleeves are configured to provide fluidic coupling between a direct sample analysis sample holder and the mass spectrometer through the capillary inlet.

7. The method of claim 6, further comprising removing a capillary nozzle cap prior to coupling the internal sleeve to the capillary inlet.

8. The method of claim 6, further comprising coupling a lens assembly to the coupled external sleeve.

9. The method of claim 6, in which the external sleeve comprises an insulator configured to electrically isolate the internal sleeve from the external sleeve.

10. The method of claim 6, in which the internal sleeve comprises an insulator configured to electrically isolate the internal sleeve from the external sleeve.

11. A method of installing a direct sample analysis device on a mass spectrometer comprising a capillary inlet while maintaining a vacuum in the mass spectrometer, the method comprising coupling an adapter comprising a coupler sized and arranged to engage to a capillary inlet of the mass spectrometer, the coupler comprising an internal surface configured to engage to the capillary of the capillary inlet through a friction fit between the internal surface of the coupler and the capillary inlet, the coupler further comprising an external surface electrically isolated from the internal surface through an insulator, in which the adapter is configured to provide fluidic coupling between a sample holder and the mass spectrometer through the capillary inlet.

12. The method of claim 11, further comprising removing a capillary nozzle cap prior to coupling the internal surface to the capillary inlet.

13. The method of claim 11, further comprising coupling a lens assembly to the coupled external surface.

14. The method of claim 13, further comprising initiating sample analysis of a sample on a direct sample analysis sample support substantially immediately after coupling the lens assembly to the external surface of the adapter.

15. The method of claim 11, further comprising maintaining a substantially constant vacuum pressure in the mass spectrometer during the coupling of the adapter.

* * * * *